US009388003B2

(12) United States Patent
Harada et al.

(10) Patent No.: US 9,388,003 B2
(45) Date of Patent: Jul. 12, 2016

(54) SHEET CONVEYING APPARATUS AND IMAGE FORMING APPARATUS

(71) Applicant: CANON KABUSHIKI KAISHA, Tokyo (JP)

(72) Inventors: Yuko Harada, Yokohama (JP); Daisuke Aoki, Yokohama (JP); Atsushi Murakami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/520,581

(22) Filed: Oct. 22, 2014

(65) Prior Publication Data

US 2015/0115526 A1 Apr. 30, 2015

(30) Foreign Application Priority Data

Oct. 30, 2013 (JP) ..... 2013-225443

(51) Int. Cl.

| | |
|---|---|
| ***B65H 7/02*** | (2006.01) |
| ***B65H 5/06*** | (2006.01) |
| ***B65H 5/38*** | (2006.01) |
| ***B65H 9/06*** | (2006.01) |
| *B65H 9/00* | (2006.01) |

(52) U.S. Cl.

CPC ..... *B65H 5/062* (2013.01); *B65H 5/38* (2013.01); *B65H 9/004* (2013.01); *B65H 9/06* (2013.01); *B65H 9/006* (2013.01); *B65H 2404/1116* (2013.01); *B65H 2404/52* (2013.01); *B65H 2404/611* (2013.01)

(58) Field of Classification Search

CPC ..... B65H 9/006; B65H 5/062; B65H 5/9004; B65H 5/36

USPC ..... 271/243

See application file for complete search history.

(56) References Cited

U.S. PATENT DOCUMENTS

| | | | | |
|---|---|---|---|---|
| 6,994,341 | B2 | 2/2006 | Aoki et al. | |
| 8,439,358 | B2 | 5/2013 | Watanabe et al. | |
| 8,740,215 | B2 | 6/2014 | Watanabe et al. | |
| 2012/0091652 | A1* | 4/2012 | Suzuki | 271/110 |
| 2012/0093554 | A1* | 4/2012 | Suzuki | 399/381 |
| 2012/0163838 | A1* | 6/2012 | Mogi | G03G 15/657 399/21 |
| 2012/0235350 | A1 | 9/2012 | Watanabe et al. | |
| 2013/0221612 | A1 | 8/2013 | Harada et al. | |
| 2013/0222505 | A1 | 8/2013 | Akatsuka et al. | |

FOREIGN PATENT DOCUMENTS

JP 2012-193019 A 10/2012

* cited by examiner

*Primary Examiner* — Howard Sanders

(74) *Attorney, Agent, or Firm* — Fitzpatrick, Cella, Harper & Scinto

(57) ABSTRACT

A sheet conveying apparatus includes a restricting portion provided on a second roller side with respect to a sheet conveying path and near a nip portion. This restricting portion is configured such that a first abutment portion is positioned on the second roller side from a straight line connecting a point protruding most to the sheet conveying path of the restricting portion and the nip portion in a state in which a second abutment portion is in contact with a surface of a first sheet as a rotary member rotates in a predetermined direction by the first abutment portion being pushed by the first sheet.

14 Claims, 8 Drawing Sheets

SHEET CONVEYING APPARATUS AND IMAGE FORMING APPARATUS

BACKGROUND OF THE INVENTION

1. Field of the Invention

The present invention relates to a sheet conveying apparatus configured to be able to convey a sheet and an image forming apparatus including the same.

2. Description of the Related Art

Lately, various technologies for improving productivity (a number of image forming sheets per unit time) of an image forming apparatus such as a copier, a printer, a facsimile, and a multi-function printer have been proposed to meet user's demands on further improvement of the productivity. For instance, various image forming apparatuses improving the productivity by shortening a distance from a rear end of a preceding sheet to a front end of a succeeding sheet (referred to as a 'distance between sheets' hereinafter) have been proposed.

As an image forming apparatus improving such productivity, Japanese Patent Application Laid-open No. 2012-193019 proposes a device configured to rotate a shutter member and to position a plurality of protruding portions of the shutter member to a standby position where the protruding portion abuts against a front end of a sheet sequentially conveyed thereto. The image forming apparatus including such device is capable of shortening the distance between sheets because the shutter member is rotated and a time required for the protruding portion to be positioned to the standby position is shortened as compared to a reciprocating type shutter member configured to return a protruding portion to a standby position after when a sheet passes through.

However, in the case of the rotational shutter member described in Japanese Patent Application Laid-open No. 2012-193019, the protruding portion correcting a skew of a next sheet stands by until when the sheet passes through in a state being in contact with a back surface of the sheet whose skew has been corrected. Therefore, in a case where the sheet whose skew has been corrected in the state in which a next protruding portion is in contact with the lower part of the sheet is jammed and if a user tries to pull out the jammed sheet in a rotational direction of the shutter, there is a possibility that the shutter rotates and a next standing-by protruding portion protrudes to the sheet conveying path. If the next protruding portion protrudes toward the sheet conveying path, there is a possibility of damaging the jammed sheet and of tearing the jammed sheet in taking out it. If the jammed sheet is torn, it becomes more difficult to unjam the sheet.

SUMMARY OF THE INVENTION

According to one aspect of the invention, a sheet conveying apparatus includes an apparatus body including a conveying path of a sheet, a conveying roller pair including a first roller provided on one side with respect to the sheet conveying path and a second roller provided on another side with respect to the sheet conveying path and conveying the sheet along the sheet conveying path by nipping the sheet by a nip portion between the first and second rollers, and a rotary member provided on the second roller side with respect to the sheet conveying path. The rotary member includes a first abutment portion against which a front end in the conveying direction of a first sheet abuts in a state in which the rotary member is positioned at a first abutment position and the rotary member is rotated in a predetermined direction from the first abutment position by the first abutment portion being pushed by the first sheet. The rotary member further includes a second abutment portion against which a front end in the conveying direction of a second sheet conveyed in succession to the first sheet abuts in a state in which the rotary member is positioned at a second abutment position rotated in the predetermined direction from the first abutment position and the rotary member is rotated in the predetermined direction from the second abutment position by the second abutment portion being pushed by the second sheet. The sheet conveying apparatus further includes a restricting portion provided on the second roller side with respect to the sheet conveying path and near the nip portion. The restricting portion is configured such that the first abutment portion is positioned on the second roller side from a straight line connecting a point protruding most to the sheet conveying path of the restricting portion and the nip portion in a state in which the second abutment portion is in contact with a surface of the first sheet as the rotary member rotates in the predetermined direction by the first abutment portion being pushed by the first sheet.

According to another aspect of the invention, a sheet conveying apparatus includes an apparatus body, a conveying roller pair including a first roller provided on one side with respect to a sheet conveying path and a second roller provided on another side with respect to the sheet conveying path and conveying the sheet along the sheet conveying path by nipping the sheet by a nip portion between the first and second roller, a rotary member provided on the second roller side with respect to the sheet conveying path. The rotary member includes a first abutment portion against which a front end in the conveying direction of a first sheet abuts in a state in which the rotary member is positioned at a first abutment position and the rotary member is rotated in a predetermined direction from the first abutment position by the first abutment portion being pushed by the first sheet. The rotary member further includes a second abutment portion against which a front end in the conveying direction of a second sheet conveyed following the first sheet abuts in a state in which the rotary member is positioned at a second abutment position rotated in the predetermined direction from the first abutment position and the rotary member is rotated in the predetermined direction from the second abutment position by the second abutment portion being pushed by the second sheet. The sheet conveying apparatus further includes an upstream guide configured to guide the sheet from upstream in the conveying direction toward the nip portion along the sheet conveying path, and a downstream guide guiding the sheet being nipped and conveyed by the nip portion of the conveying roller pair on the side downstream in the conveying direction of the nip portion. The downstream guide has a restricting portion provided on the second roller side with respect to the sheet conveying path and the restricting portion is configured to protrude such that the second abutment portion is positioned on the second roller side rather than a guide surface of the first roller side of the upstream guide in a state in which a front end portion of the first abutment portion is positioned on a straight line connecting a point protruding most to the sheet conveying path of the restricting portion and the nip portion.

Further features of the present invention will become apparent from the following description of exemplary embodiments with reference to the attached drawings.

DESCRIPTION OF THE EMBODIMENTS

An image forming apparatus of an embodiment of the present invention will be explained below with reference to the drawings. The image forming apparatus of the following embodiment is an image forming apparatus including a sheet conveying portion, i.e., a sheet conveying apparatus, such as a copier, a printer, a facsimile, and a multi-function printer. The image forming apparatus will be explained by exemplifying an electro-photographic laser beam printer (referred to as a 'printer' hereinafter) in the following embodiment.

<First Embodiment>

Figure 1:
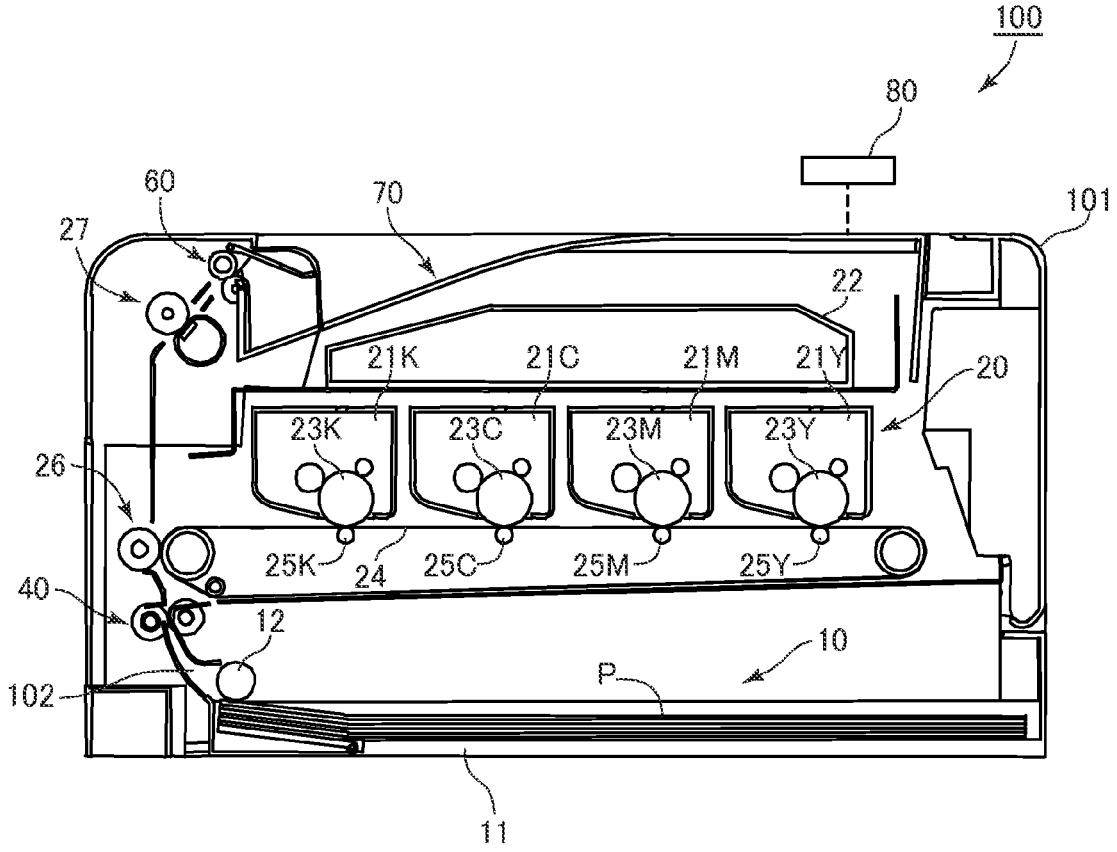
FIG. 1 is a section view schematically showing a printer of a first embodiment.
Figure 2:
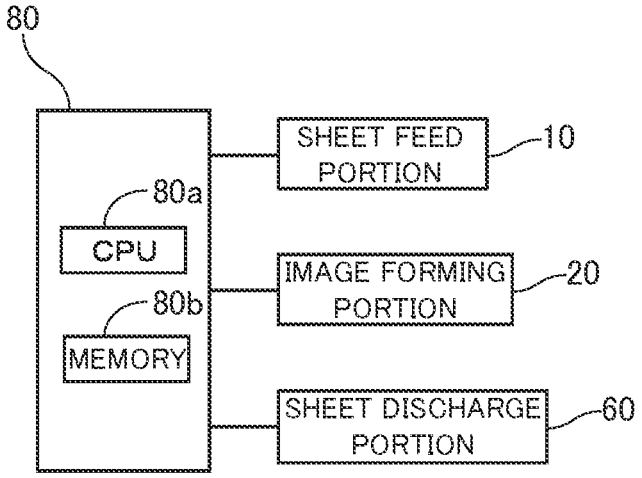
FIG. 2 is a block diagram showing a configuration of a control portion of the printer of the first embodiment.

The printer 100 of the first embodiment will be explained with reference to FIGS. 1 through 5. A schematic configuration of the printer 100 will be explained at first with reference to FIGs. 1 and 2. FIG. 1 is a section view schematically showing the printer 100 of the first embodiment. FIG. 2 is a block diagram showing a configuration of a control portion 80 of the printer 100 of the present embodiment.

As shown in FIG. 1, the printer 100 includes a sheet feeding portion 10 configured to feed a sheet P, a sheet conveying portion (sheet conveying apparatus) 40 configured to convey the sheet P, an image forming portion 20 configured to form an image on the sheet P, and a sheet discharge portion 60 configured to discharge the sheet P on which the image has been formed to out of the apparatus. A sheet conveying path 102 through which the sheet P is conveyed by the sheet feeding portion 10, the sheet conveying portion 40 and the sheet discharge portion 60 described above is formed within a printer body (apparatus body or image forming apparatus body) 101 of the printer 100. The printer 100 also includes a discharged sheet stacking portion 70 on which the sheet P discharged thorough the sheet conveying path 102 is stacked and a control portion 80 controlling those devices described above.

The sheet feeding portion 10 includes a fed sheet stacking portion 11 on which the sheet P is stacked and a feed roller 12 feeding the sheet P stacked on the fed sheet stacking portion 11 one by one. The sheet conveying portion 40 is disposed between the sheet feeding portion 10 and the image forming portion 20, and conveys the sheet P fed from the sheet feeding portion 10 to the image forming portion 20. It is noted that the sheet conveying portion 40 will be explained in detail later.

The image forming portion 20 includes four process cartridges 21Y through 21K configured to form images of yellow (Y), magenta (M), cyan (C), and black (K), and an exposure device 22 configured to expose surfaces of photosensitive drums 23Y through 23K described later. It is noted that because the four process cartridges 21Y through 21K have the same configuration, respectively, except that the colors of the images to be formed are different, only the configuration of the process cartridge 21Y forming the yellow (Y) image will be explained and an explanation of the other process cartridges 21M through 21K will be omitted here.

The process cartridge 21Y includes the photosensitive drum 23Y, a charging roller electrifying the photosensitive drum 23Y, and a developing roller developing an electrostatic latent image formed on the photosensitive drum 23Y. The image forming portion 20 also includes an intermediate transfer belt 24 to which toner images on the photosensitive drums 23Y through 23K are primarily transferred and primary transfer rollers 25Y through 25K primarily transferring the toner images to the intermediate transfer belt 24. The image forming portion 20 further includes a secondary transfer portion 26 configured to secondarily transfer the primarily transferred toner images to the sheet P as described later and a fixing portion 27 configured to heat and fix the secondarily transferred toner images to the sheet P.

As shown in FIG. 2, the control portion 80 includes a CPU 80*a* driving and controlling the sheet feeding portion 10, the image forming portion 20, the sheet discharge portion 60 and others, and a memory 80*b* storing various programs and information such as an image forming program configured to execute an image forming operation. The control portion 80 forms an image on the sheet P by using them.

Next, the image forming operation (the image forming operation controlled by the control portion 80) of the printer 100 constructed as described above will be explained. In response to image information inputted from an external PC or the like, the exposure device 22 irradiates a laser beam to the photosensitive drums 23Y through 23K on a basis of the inputted image information. At this time, the photosensitive drums 23Y through 23K have been electrified in advance by the charging roller, and electrostatic latent images are formed on the photosensitive drums 23Y through 23K by the irradiation of the laser beam. After that, the electrostatic latent images are developed by the developing roller and toner images of yellow (Y), magenta (M), cyan (C) and black (K) are formed on the photosensitive drums 23Y through 23K, respectively. The toner images of the respective colors formed on the photosensitive drums 23Y through 23K are superimposed and transferred to the intermediate transfer belt 24 by the primary transfer rollers 25Y through 25K and are conveyed to the secondary transfer portion 26 by the intermediate transfer belt 24.

In parallel with the image forming operation described above, the sheet P stacked on the fed sheet stacking portion 11 is fed by the feed roller 12 one by one toward the sheet conveying portion 40. The sheet conveying portion 40 corrects a skew of the sheet P and conveys the sheet P to the secondary transfer portion 26 on a predetermined conveying timing. The toner images on the intermediate transfer belt 24 are transferred to the sheet P in the secondary transfer portion 26. The toner images transferred to the sheet P are fixed in the fixing portion 27. The sheet P is then discharged by the sheet discharge portion 60 out of the apparatus and is stacked on the discharged sheet stacking portion 70.

Figure 3:
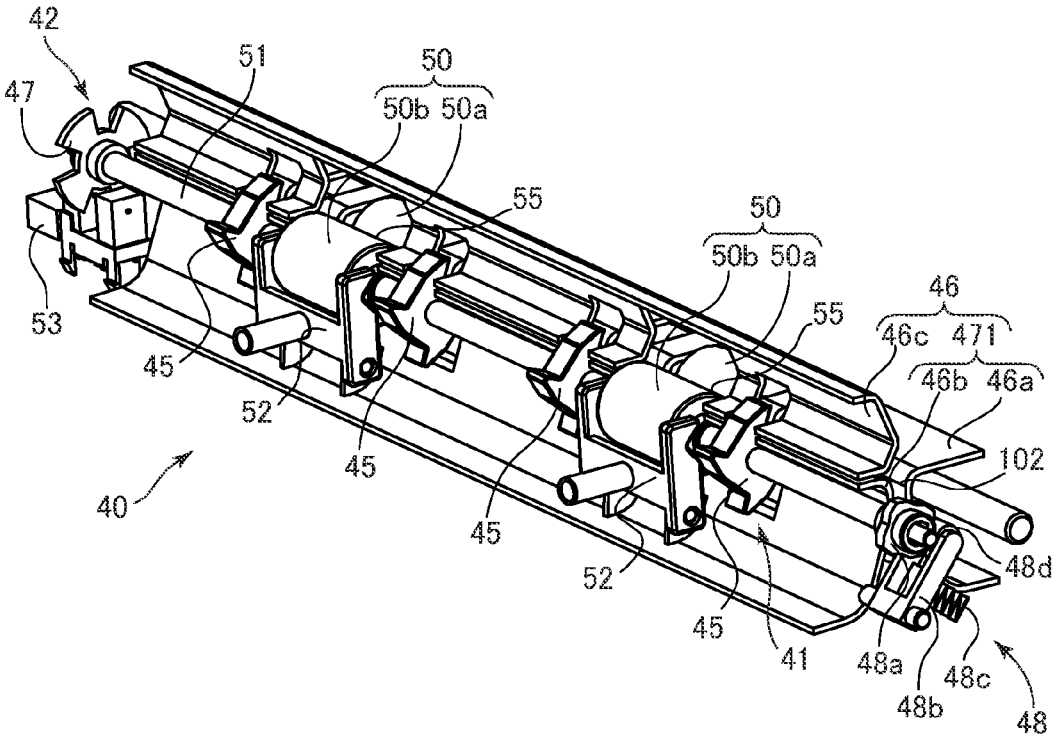
FIG. 3 is a perspective view of a sheet conveying portion of the printer of the first embodiment.
Figure 4A:
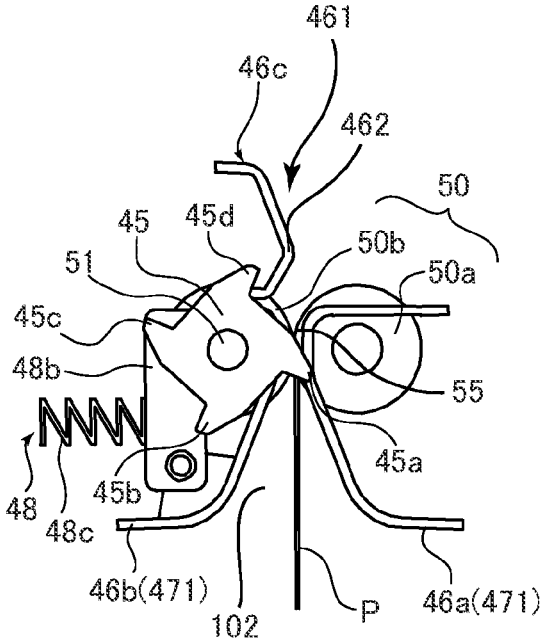
FIG. 4A is a schematic diagram showing a state in which a shutter member is positioned at a standby position.
Figure 4B:
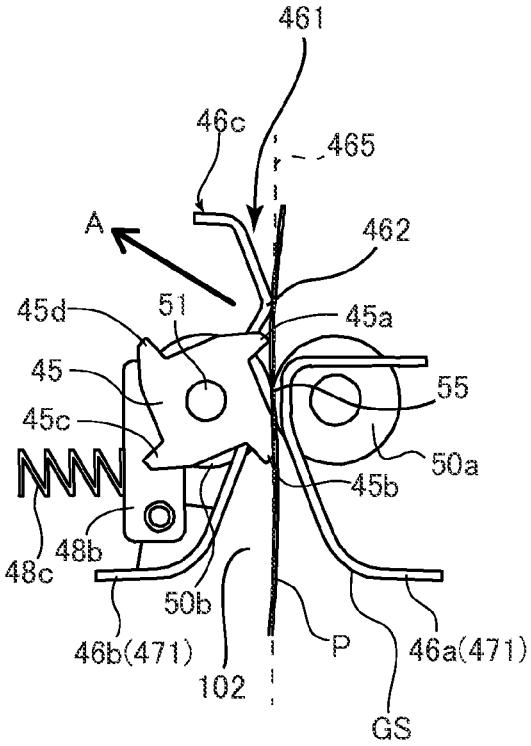
FIG. 4B is a schematic diagram showing a state in which the shutter member is positioned at a recede position.

Next, the sheet conveying portion 40 described above will be specifically explained with reference to FIGS. 3, 4A and 4B. At first, a schematic configuration of the sheet conveying portion 40 will be explained with reference to FIGS. 3, 4A and 4B. FIG. 3 is a perspective view of the sheet conveying portion 40 of the printer 100 of the first embodiment. FIG. 4A is a section view showing a state in which the sheet P passes through the sheet conveying portion 40 and a shutter member is positioned at standby position. FIG. 4B shows a state in which the shutter member is positioned at a recede position.

As shown in FIG. 3, the sheet conveying portion 40 includes a conveying roller pair 50 conveying the sheet P, a skew correcting portion 41 correcting the skew of the sheet P, a sheet detecting portion 42 capable of detecting the sheet P, and a conveyance guide 46 guiding the sheet P to the image forming portion 20.

The conveying roller pair 50 includes a conveying roller (first roller) 50*a* rotationally driven by a driving portion not shown and a conveying driven roller (second roller) being in pressure contact with the conveying roller 50*a* and rotationally driven by the conveying roller 50*a*. It is noted that the conveying driven roller 50*b* is pressed to the conveying roller 50*a* by pressing a rotational shaft 51 rotatably supporting the conveying driven roller 50*b* by a pressing member 52. That is, the conveying roller 50*a* is provided at one side (first side) with respect to a sheet conveying path 102 composed of the conveyance guide 46, and the conveying driven roller 50*b* is provided at another side (second side) with respect to the sheet conveying path 102. Then, the conveying roller pair 50 nips the sheet P by the nip portion 55 between the conveying roller 50*a* and the conveying driven roller 50*b* and conveys the sheet P along the sheet conveying path 102.

The skew correcting portion 41 includes a plurality of shutter members (rotary members) 45 secured to the rotational shaft 51 and a positioning portion 48 positioning the plurality of shutter members 45 at predetermined rotational positions.

The plurality of shutter members 45 is secured to the rotational shaft 51 of the conveying driven roller 50*b* on the conveying driven roller 50*b* side with respect to the sheet conveying path 102 and is rotatable with respect to the printer body 101. Each of the plurality of shutter members (four in the present embodiment) 45 is provided with a plurality of protruding portions (four in the present embodiment) 45*a*, 45*b*, 45*c* and 45*d* on an outer circumference thereof at equal intervals in a circumferential direction. These protruding portions 45*a* through 45*d* are secured to the rotational shaft 51 such that the protruding portions 45*a* through 45*d* are in phase with each other. That is, the shutter members 45 are provided coaxially with the conveying driven roller 50*b* and the protruding portions 45*a* through 45*d* are formed such that they protrude out of the sheet conveying path 102 when they are positioned at the standby position (abutting position) upstream in a sheet conveying direction of the nip portion 55 of the conveying roller pair 50 as shown in FIG. 4A. It is noted that the standby position is a position where the protruding portion 45*a* for example is positioned upstream in the conveying direction of the nip portion 55 of the conveying roller pair 50 and where the protruding portion 45*a* can abut against a front end of the sheet P guided toward the sheet conveying portion 40 as shown in FIG. 4A. Because each of the shutter members 45 has the first through fourth protruding portions 45*a* through 45*d* in the present embodiment, each of these first through fourth protruding portions 45*a* through 45*d* is positioned at the standby position when the shutter members 45 rotate to first through fourth abutment positions where the front end of the sheet P abut against the protruding portions 45*a* through 45*d* as described later.

Still further, as shown in FIG. 4B for example, the protruding portions 45*a* through 45*d* are formed such that the protruding portion 45*a* pushed by the sheet P recedes from the sheet conveying path 102 and the next protruding portion 45*b* is positioned at the recede position where the protruding portion 45*b* waits by being in contact with a surface of the sheet P moving through the sheet conveying path. It is noted that although the present embodiment will be explained by exemplifying the shutter member 45 having the four protruding portions 45*a* through 45*d*, the number of the protruding portions is not limited to be four. That is, the shutter member 45 is only required to have at least first and second abutment portions, i.e., the first and second protruding portions, 45*a* and 45*b*. The first abutment portion 45*a* abuts against a front end in the conveying direction of a first sheet (preceding sheet) conveyed thereto when the shutter member 45 is positioned at a first abutment position and the shutter member 45 is rotated in a predetermined direction (counterclockwise in FIG. 4A) from the first abutment position by the first abutment portion 45*a* being pushed by the first sheet. The second abutment portion 45*b* abuts against a front end in the conveying direction of a second sheet (succeeding sheet) conveyed thereto following the first sheet when the shutter member 45 is positioned at a second abutment position rotated in the predetermined direction from the first abutment position and the shutter member 45 is rotated in the predetermined direction from the second abutment position by the second abutment portion 45*b* being pushed by the second sheet. These first and second abutment portions 45*a* and 45*b* abut against the sheet at the first and second abutment positions upstream in the conveying direction of the nip portion 55 of the conveying roller pair 50 and correct a skew of the sheet conveyed to the nip portion 55.

The positioning portion 48 includes a cam member 48*a* secured to one end of the rotational shaft 51, a bias arm 48*b* biasing the cam member 48*a*, and a bias spring 48*c* biasing the bias arm 48*b*.

The cam member 48*a* has the same number of cams (four in the present embodiment) with the protruding portions 45*a* through 45*d*. The cams are formed such that the protruding portions 45*a* through 45*d* are positioned at the standby position. That is, the cam member 48*a* is formed of four sets of a resistance side cam surface and a driving side cam surface formed with a top dead point between them by its outer circumferential surface and has four bottom dead points corresponding to the first through fourth abutment positions (between the driving side cam surface and the adjacent resistance side cam surface). The bias arm 48*b* includes a cam follower 48*d* in contact with the cam (the set of the resistance side and driving side cam surfaces) of the cam member 48*a* and oscillates in a state biased by the bias spring 48*c* to position the cam member 48*a* to a predetermined position (bottom dead point) such that the protruding portions 45*a* through 45*d* are positioned at the standby position. For instance, as shown in FIG. 4A, the positioning portion 48 positions the protruding portion 45*a*, i.e., the first abutment portion, at the standby position (the first abutment position) and the shutter member 45 rotates in the predetermined direction because the protruding portion 45*a* is pushed by the front end of the first conveyed sheet P. At this time, when the cam follower 48*d* moves over the top dead point and comes into contact with the driving side cam surface from the resistant resistance side cam surface, the positioning portion 48 rotates the shutter member 45 in the predetermined direction and positions the protruding portion 45*b*, i.e., the second abutment portion, to the standby position (that, is, positions the shutter member 45 to the second abutment position).

In other word, the positioning mechanism 48 includes the cam member 48*a*, the cam follower 48*d* contacting with the cam member 48*a* and an elastic member, e.g., the bias spring 48*c*, biasing the cam follower 48*d* toward the cam member 48*a*. The positioning mechanism 48 positions the shutter member (rotary member) 45 at the second abutment position by rotating the shutter member 45 in the predetermined direction, e.g., the counterclockwise direction in FIG. 4, after the shutter member 45 starting to be rotated in the predetermined direction by the protruding portion (first abutment portion) 45*a* being pushed by the first sheet.

The sheet detecting portion 42 includes shading flags 47 secured to another end portion of the rotational shaft 51 and a photo sensor 53 having light emitting and receiving portions. The shading flags 47 are secured to the rotational shaft 51 such that the shading flags 47 rotate in phase with the plurality of protruding portions 45*a* through 45*d* of the shutter member 45 and change over shading and transmission (shading states) of the photo sensor 53 corresponding to the positions of the protruding portions 45*a* through 45*d*. In the present embodiment, when any one of the protruding portions 45*a* through 45*d* is positioned at the recede position, the shading flag 47 shades the photo sensor 53 and the photo sensor 53 transmits a predetermined signal when the photo sensor 53 is shaded by any one of the protruding portions 45*a* through 45*d*. That is, the photo sensor 53 is a detection portion detecting the rotation of the shutter member 45 and enables to detect a passage of the sheet.

The conveyance guide 46 composes the sheet conveying path 102 between the sheet feeding portion 10 and the secondary transfer portion 26 of the image forming portion 20 and includes an upstream guide 471 located upstream of the nip portion 55 of the conveying roller pair 50 and a downstream guide 46*c* located downstream of the nip portion 55 of the conveying roller pair 50.

The upstream guide 471 includes a first upstream guide 46*a* and a second upstream guide 46*b*. The first upstream guide 46*a* is disposed on the conveying roller 50*a* side and the second upstream guide 46*b* is disposed on the conveying driven roller 50*b* side. These first and second upstream guides 46*a* and 46*b* guide the sheet P fed by the feed roller 12 to the nip portion 55 of the conveying roller pair 50.

The downstream guide 46*c* is disposed on the conveying driven roller 50*b* side and guides the sheet P that has passed the nip portion 55 of the conveying roller pair 50 to the secondary transfer portion 26. The downstream guide 46*c* is also arranged such that the protruding portion 45*a* positioned at the recede position by being pushed by the sheet P as shown in FIG. 4B does not protrude from a conveying surface connecting the nip portion 55 of the conveying roller pair 50 and the downstream guide 46*c*. In other words, the downstream guide 46*c* is arranged such that at least a part thereof is located on a side opposite from the rotational shaft 51 of the shutter member 45 over an extension line connecting the protruding portion 45*a* and the protruding portion 45*b*.

More specifically, the downstream guide 46*c* has a restricting portion 461 provided on the conveying driven roller 50*b* side with respect to the sheet conveying path 102 and near the nip portion 55 of the conveying roller pair 50. This restricting portion 461 is formed of the bending downstream guide 46*c* and protrudes to the sheet conveying path 102 from the conveying roller 50*a* side to the conveying driven roller 50*b* side. Still further, as shown in FIG. 4B, the restricting portion 461 is configured such that the protruding portion 45*a* is positioned on the conveying roller (second roller) 50*b* side from a straight line 465 connecting a point 462 where the restricting portion 461 protrudes most to the sheet conveying path and the nip portion 55 in the state in which the protruding portion (second abutment portion) 45*b* is in contact with the surface of the first sheet as the shutter member (rotary member) 45 rotates in the predetermined direction because the protruding portion (the first abutment portion) 45*a* is pushed by the first sheet P.

In other words, the downstream guide 46*c* guides the sheet P being conveyed by being nipped by the nip portion 55 of the conveying roller pair 50 on the side downstream in the conveying direction of the nip portion 55 and includes the restricting portion 461 provided on the conveying driven roller (second roller) 50*b* side with respect to the sheet conveying path 102 and protruding to the conveying roller (first roller) 50*a* side. This restricting portion 461 is configured to protrude such that the protruding portion (second abutment portion) 45*b* is positioned on the conveying driven roller (second roller) 50*b* side rather than a guide surface (GS) on the conveying roller (first roller) 50*a* side of the upstream guide 471 in a state in which a front end portion of the protruding portion (first abutment portion) 45*a* is positioned on a straight line 465 (substantially identical with the surface of the sheet P in FIG. 4B) connecting the point 462 protruding most to the sheet conveying path 102 of the restricting portion 461 and the nip portion 55.

Next, a skew correcting operation of the sheet conveying portion 40 constructed as described above will be explained with reference to FIGS. 4A and 4B.

When the sheet P is fed from the feed roller 12, the sheet P abuts against the second upstream guide 46*b* and is guided toward the nip portion 55 of the conveying roller pair 50 while sliding on the second upstream guide 46*b*. The sheet P guided toward the nip portion 55 of the conveying roller pair 50 is stopped by the protruding portion 45*a* positioned at the standby position upstream of the nip portion 55 to correct a skew thereof. Specifically, when the sheet P abuts against the protruding portion 45*a*, the sheet P forms a loop. Because the sheet P forms the loop, the front end of the sheet P is aligned by the protruding portion 45*a* and the skew of the sheet P is corrected. It is noted that at this time, the protruding portion 45*a* is biased by the positioning portion 48 such that the protruding portion 45*a* is positioned to the standby position.

The sheet P whose skew has been corrected pushes the protruding portion 45*a* positioned at the standby position by resisting against a bias force of the positioning portion 48 by stiffness (rigidity) of the sheet P and rotates the shutter member 45. When the shutter member 45 rotates, the protruding portion 45*a* pushed by the sheet P recedes from the sheet conveying path 102 and the sheet P is nipped and conveyed by the nip portion 55 of the conveying roller pair 50. At this time, while the next protruding portion 45*b* tries to move to the standby position by the bias force of the positioning portion 48, the protruding portion 45*b* stands by in a state in contact with the surface 465 of the sheet P because the sheet P is in a middle of the move.

When the sheet P passes through the protruding portion 45*b*, the next protruding portion 45*b* moves to the standby position by the bias force of the positioning portion 48. It is possible to shorten a time until when the next protruding portion 45*b* is positioned to the standby position by arranging such that the shutter member 45 rotates and the next protruding portion 45*b* is positioned to the standby position along with the passage of the sheet P. Therefore, it is possible to shorten a distance between the sheets being fed (the distance between sheets).

Here, if the sheet P jams in the state in which the protruding portion 45*a* pushed by the sheet P recedes from the sheet conveying path 102 and the next protruding portion 45*b* is positioned at the recede position where the protruding portion 45*b* stands by while in contact with the surface of the sheet P, the sheet conveying portion 40 stops in this state. Here, the printer body 101 is constructed to permit to access to the sheet conveying path 102 from the outside of the apparatus on the side downstream in the conveying direction of the nip portion 55 through an intermediary of an opening/closing door not shown. Therefore, if the jammed sheet is pulled in a direction of an arrow A shown in FIG. 4B to remove the jammed sheet from this state, the pulled jammed sheet pushes the protruding portion 45*a* in the direction of the arrow A and the shutter member 45 rotates if the downstream guide 46*c* does not exist. If the shutter member 45 rotates, the protruding portion 45*b* turns toward the sheet conveying path 102. Then, there is a possibility that the jammed sheet positioned at the sheet conveying path 102 is damaged and is possibly torn by the protruding portion 45*b*. If the jammed sheet is damaged, the sheet may become unusable even if it is taken out. Still further, if the jammed sheet is torn within the sheet conveying portion 40, it becomes hard to unjam the sheet.

Then, in the present embodiment, the downstream guide 46*c* is arranged such that the protruding portions 45*a* through 45*d* (the protruding portion 45*a* in FIG. 4B) pushed by the sheet P and positioned at the recede position do not protrude out of the conveying surface connecting the nip portion 55 of the conveying roller pair 50 and the downstream guide 46*c*. In other words, in the state shown in FIG. 4B, the downstream guide 46*c* is arranged such that at least a part thereof is positioned on the side opposite from the rotational shaft 51 of the shutter member 45 from the extension line 465 of the line connecting the protruding portions 45*a* and 45*b*. Therefore, even if the jammed sheet is pulled in the direction of the arrow A, the jammed sheet slides along the downstream guide 46*c*, so that it is possible to prevent the shutter member 45 from rotating unnecessarily. This arrangement makes it possible to prevent the jammed sheet from been damaged or torn.

That is, even if the sheet P is pulled in the A direction from the state shown in FIG. 4B, the protruding portion 45*a* recedes to a recede space formed between the restricting portion 461 of the downstream guide 46*c* and the conveying driven roller 50*b*, the shutter member 45 is not rotated more from the state shown in FIG. 4B by a force of the user pulling the sheet P through the sheet P. Accordingly, no greater rotational force than the rotational force caused by the bias spring 48*c* of the positioning portion 48 acts on the shutter member 45 and it is possible to prevent the shutter member 45 from turning until when the protruding portion 45*b* overlaps with the first upstream guide 46*a* viewing from the axial direction in the state in which the protruding portion 45*b* of the shutter member 45 is in contact with the sheet P and to prevent the protruding portion 45*b* biting into the sheet. Due to that, even if the sheet P jams during when it is nipped and conveyed by the nip portion 55 of the conveying roller pair 50, there will be no such a thing that the sheet P is caught between the protruding portion 45*b* and the first upstream guide 46*a* and cannot be pulled out and the user will not pull out the sheet in the direction of the arrow A more than necessary, so that the damage otherwise given to the jammed sheet in taking out can be lessened.

Still further, because the downstream guide 46*c* guides the sheet P to the secondary transfer portion 26 during a normal conveying operation, this arrangement makes it possible to provide the first sheet conveying portion 40 allowing the stable sheet conveyance and the easy unjamming operations.

Figure 5:
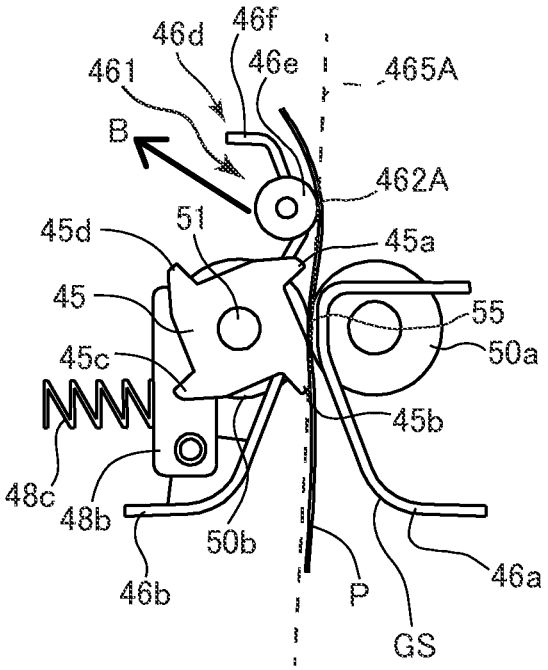
FIG. 5 is a section view showing another mode of the sheet conveying portion of the first embodiment.

Next, another mode of the sheet conveying portion 40 of the first embodiment will be explained with reference to FIG. 5. FIG. 5 is a section view showing the other mode of the sheet conveying portion of the first embodiment.

As shown in FIG. 5, a downstream guide 46*d* is provided with a guide roller 46*e* rotatably supported at a guide wall 46*f* thereof and guiding the sheet P that has passed through the nip portion 55 along the sheet conveying path 102. While the restricting portion 461 described above composes at least a part of the downstream guide 46*c*, the restricting portion 461 is composed of the guide roller 46*e* in this mode.

That is, the point protruding most to the sheet conveying path 102 of the restricting portion 461 is a point 462A protruding most to the sheet conveying path 102 of the guide roller 46*e* in this mode. Then, in a state shown in FIG. 5, the protruding portion 45*a* is positioned on the conveying driven roller 50*b* side away from a straight line 465A connecting the point 462A protruding most to the sheet conveying path 102 and the nip portion 55. Therefore, even if the sheet P is jammed and pulled in the arrow B direction in FIG. 5, the shutter member 45 will not be rotated by the pulling force of the jammed sheet similarly to the case of FIG. 4B. Accordingly, it is possible to prevent the jammed sheet from being caught between the protruding portion 45*b* and the first upstream guide 46*a*.

Still further, it is possible to reduce a sliding resistance caused against the downstream guide 46*d* in taking out the jammed sheet in a direction of an arrow B shown in FIG. 5 by providing the guide roller 46*e* on the downstream guide 46*d*. It is also possible to reduce the damage otherwise given to the jammed sheet by reducing the sliding resistance against the downstream guide 46*d*. It is noted that the guide roller 46*e* may be formed into a form extending in a sheet width direction orthogonal to the sheet conveying direction or into a plurality of forms divided in the sheet width direction.

<Second Embodiment>

Figure 6A:
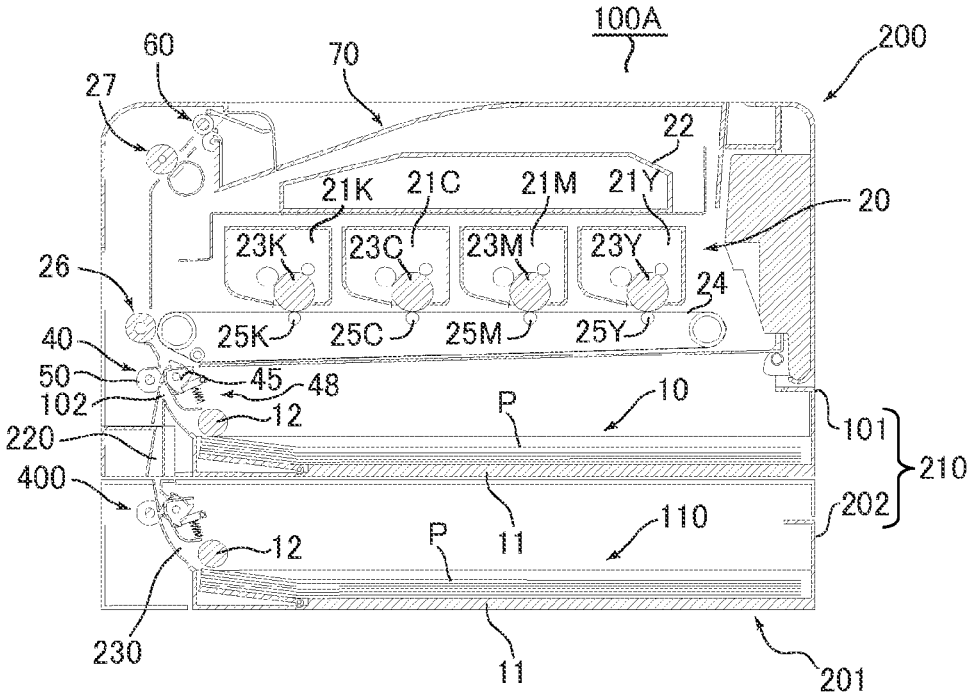
FIG. 6A is a section view schematically showing a printer of a second embodiment.
Figure 6B:
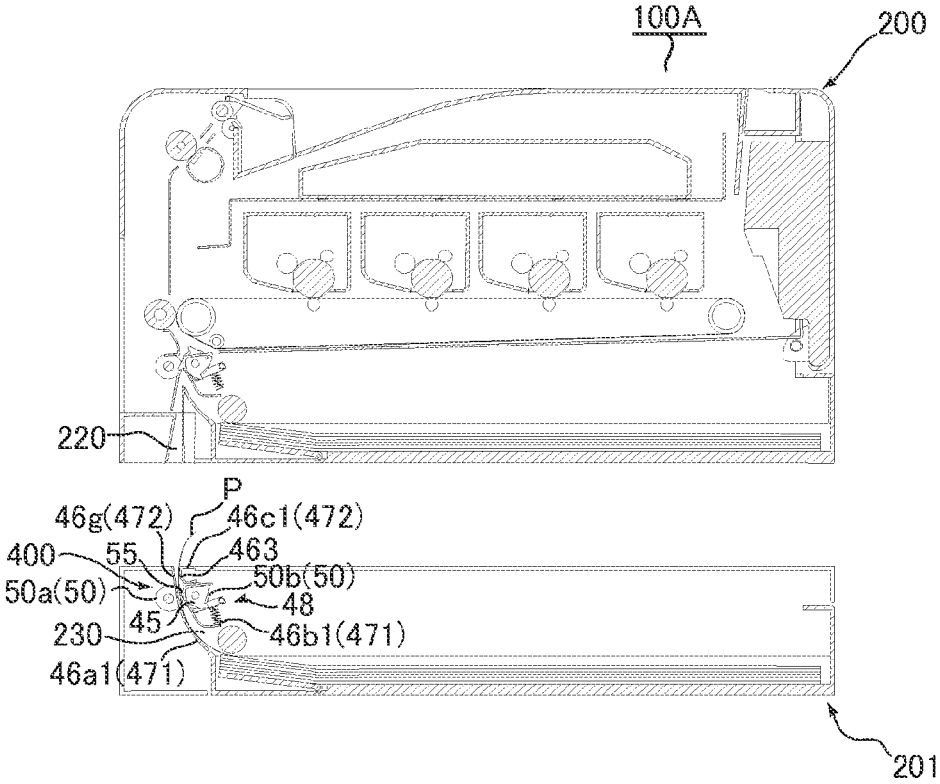
FIG. 6B is a schematic diagram showing the printer of FIG. 6A in which an image forming unit is separated from an option tray.

Next, a printer 100A of a second embodiment will be explained with reference to FIGS. 6A and 6B. The printer 100A of the second embodiment is different from the printer 100 of the first embodiment in that an option tray 201 is attached and that the restricting portion described above is applied to the option tray 201. Therefore, the following explanation will be made centering on the differences from the first embodiment, and an explanation of the similar components will be omitted here by denoting them with the same reference numerals. FIGS. 6A and 6B are section views seen from a side opposite from that of FIGS. 4A and 4B. That is, a right-hand side in FIGS. 6A and 6B corresponds to a left-hand side in FIGS. 4A and 4B and a left-hand side in FIGS. 6A and 6B corresponds to a right-hand side in FIGS. 4A and 4B.

As shown in FIGS. 6A and 6B, the printer 100A of the second embodiment includes an image forming unit 200 having the image forming portion 20 configured to form an image on a sheet, and the option tray 201. The image forming unit 200 is attached above the option tray 201.

The image forming unit 200 is constructed substantially in the same manner with the printer 100 of the first embodiment and includes the image forming portion 20 configured to form an image on a sheet fed from a sheet feed portion 10 within the image forming unit 200 (referred to as a 'first sheet feed portion' hereinafter) 10 or from a sheet feed portion 100 within the option tray 201 (referred to as a 'second sheet feed portion' hereinafter) 110. The image forming unit 200 includes the first sheet conveying portion 40, and this first sheet conveying portion 40 includes a sheet conveying path 220 for receiving the sheet P conveyed from the option tray 201 side. In order to convey the sheet P to the conveying roller pair 50, the sheet conveying path 220 joins together with the sheet conveying path 102 for conveying the sheet P from the first sheet feed portion 10 to the conveying roller pair 50 near the conveying roller pair 50 and another end of the sheet conveying path 220 is opened to a bottom portion of the image forming unit 200.

The option tray 201 includes the second sheet feed portion 110 constructed substantially identically with the first sheet feed portion 10 and a second sheet conveying portion 400. As the printer (image forming apparatus) 100A as a whole, these first and second sheet conveying portions 40 and 400 compose the sheet conveying apparatus conveying the sheet P to the image forming portion 20, and the second sheet conveying portion 400 forms the sheet conveying apparatus of the option tray 201 by itself. Still further, as the printer 100A as a whole, the printer body/conveying apparatus body (apparatus body) 210 is composed of a case 101 of the image forming unit 200 and a case 202 of the option tray 201, and the case 202 of the option tray 201 composes the conveying apparatus body (apparatus body) in a case where only the option tray 201 is concerned. That is, the apparatus body 202 of the sheet conveying apparatus (second sheet conveying portion) 400 is configured such that the image forming unit 200 is detachably mounted above in the case where only the option tray 201 is concerned.

Similarly to the first sheet conveying portion 40, the second sheet conveying portion 400 also includes the conveying roller pair 50, the shutter member 45, the positioning portion 48 and upstream, and downstream guides 471 and 472 composing a sheet conveying path 230 within the case 202. The upstream guide 471 includes a first upstream guide 46*a*1 on the conveying roller 50*a* side and a second upstream guide 46*b*1 on the conveying driven roller 50*b* side with the sheet conveying path 230 between them.

The downstream guide 472 also includes a first downstream guide 46*e* on the conveying roller 50*a* side and a second downstream guide 46*c*1 on the conveying driven roller 50*b* side with the sheet conveying path 230 between them. These first and second downstream guides 46*e* and 46*c*1 are constructed so as to extend the sheet conveying path 230 upward so as to open to be able to be connected with the sheet conveying path 220 of the image forming unit side at an upper surface of the case 202 of the option tray 201.

The second downstream guide 46*c*1 has a restricting portion 463 having substantially an identical configuration with that of the first embodiment formed by bending the guide. For instance, in a same state with the state shown in FIG. 4B, the protruding portion 45*a* of the shutter member 45 is positioned on the conveying driven roller 50*b* side from a straight line 465 connecting a point protruding most to the sheet conveying path of the restricting portion 463 and the nip portion 55 of the conveying roller pair 50.

If a sheet jams at the conveying roller pair 50 of the option tray 201, the user releases a link mechanism not shown and separates the image forming unit 200 from the option tray 201 as shown in FIG. 6B. When the image forming unit 200 is separated from the option tray 201, the sheet conveying path 230 is exposed on the upper surface of the case 202 of the option tray 201 and it becomes possible to access to the sheet conveying path 230 from the outside of the apparatus body.

Due to that, the user can pull out the sheet P out of the nip portion 55 of the conveying roller pair 50 by pulling the jammed sheet P projecting out of the opening of the sheet conveying path 230 opened to the upper surface of the option tray 201. At this time, even if the user pulls the sheet P to the conveying driven roller 50*b* side (to the right-hand side in FIG. 6B), the sheet P is restricted by the restricting portion 463 and the shutter member 45 is not rotated excessively by the sheet P. Therefore, the jammed sheet P will not be caught between the protruding portion 45*b* of the shutter member 45 and the second upstream guide 46*a*1 and the jammed sheet P can be pulled out of the nip portion 55 of the conveying roller pair 50 without damaging the sheet. It is noted that the restricting portion 463 may be composed of a guide roller as described in the other mode of the first embodiment.

<Third Embodiment>

Next, a sheet conveying portion 140 of a third embodiment of the invention will be explained with reference to FIGS. 7, 8A and 8B. The third embodiment is different from the first embodiment in that a sheet detecting portion 142 having a rotary member 145 is provided instead of the shutter member 45 correcting the skew of the sheet P and that shapes of conveying guides are different. Therefore, the following explanation will be made centering on the sheet detecting portion 142 and the conveyance guide 146 and an explanation of the other components will be omitted here by denoting the same reference numerals with those of the first embodiment.

It is noted that although the sheet conveying portion 40 has been disposed between the first sheet feed portion 10 and the image forming portion 20 in the first embodiment, the sheet conveying portion 140 of the third embodiment may be provided between the secondary transfer portion 26 and the fixing portion 27 or between the fixing portion 27 and the sheet discharge portion 60 for example. That is, the sheet conveying portion 140 is provided at a spot where it is necessary to detect a sheet.

At first, a schematic configuration of the sheet conveying portion 140 will be explained with reference to FIGS. 7, 8A and 8B. FIG. 7 is a perspective view of the sheet conveying portion 140 of the printer of the third embodiment and FIGS. 8A and 8B are section views showing states in which the sheet P passes through the sheet conveying portion 140.

Figure 7:
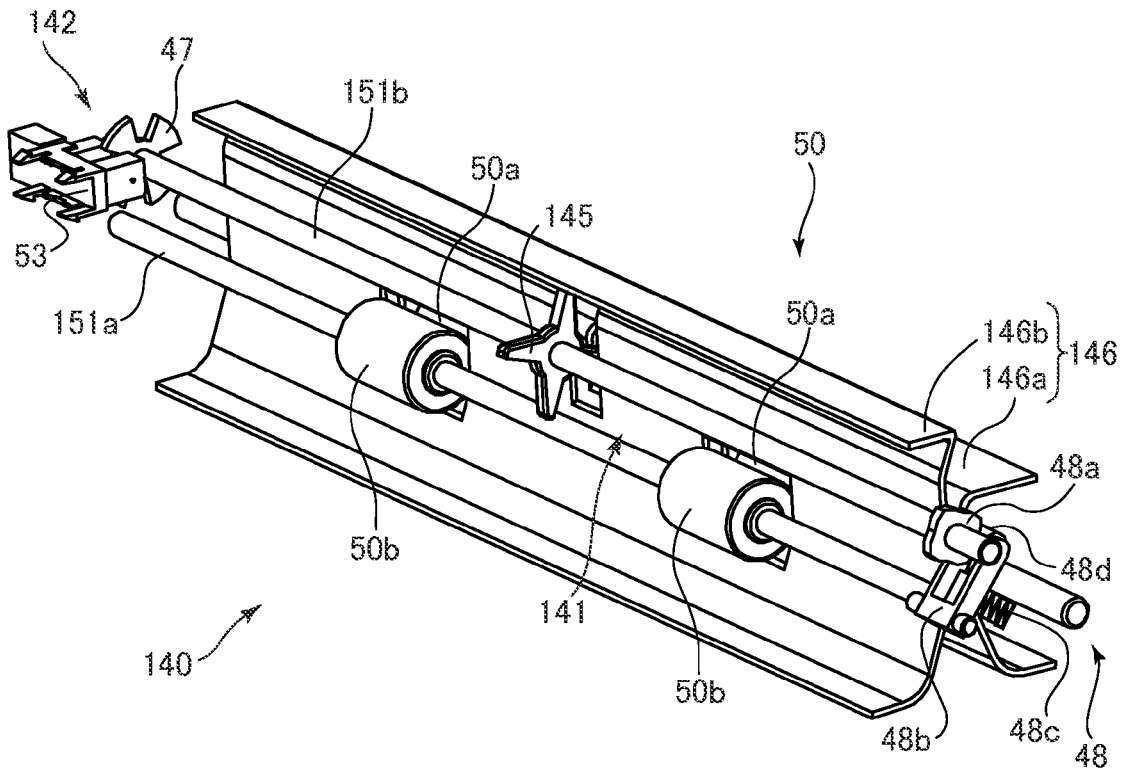
FIG. 7 is a perspective view of a sheet conveying portion of a printer of a third embodiment.
Figure 8A:
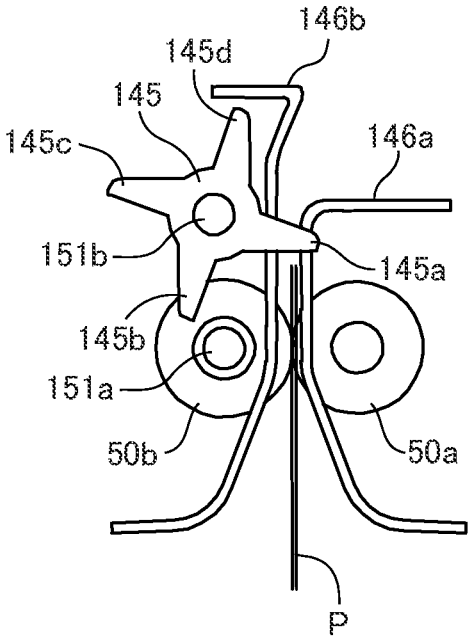
FIG. 8A is a section view showing a state in which a rotary member is positioned at a standby position.

As shown in FIG. 7, the sheet conveying portion 140 includes the conveying roller pair 50 conveying the sheet P, the sheet detecting portion 142 capable of detecting whether or not the sheet P is present, and the conveying guide 146 guiding the sheet P to the image forming portion 20.

The sheet detecting portion 142 includes the rotary member 145 secured to a rotational shaft 151*b*, the positioning portion 48 secured to one end of the rotational shaft 151*b*, the shading flag 47 secured to another end of the rotational shaft 151*b*, and the photo sensor 53 having light emitting and receiving portions.

The rotary member 145 is provided with a plurality of protruding portions (four in the present embodiment) 145*a*, 145*b*, 145*c* and 145*d* provided on an outer circumferential surface of the rotary member 145 at equal intervals in a circumferential direction. These protruding portions 145*a* through 145*d* are formed such that they protrude out of the sheet conveying path when they are positioned at a standby position (protruding position) upstream in the sheet conveying direction of the nip portion 55 of the conveying roller pair 50 as shown in FIG. 8A. It is noted that the standby position is a position where the protruding portion 145*a* for example is positioned upstream in the conveying direction of the nip portion 55 of the conveying roller pair 50 and where the protruding portion 145*a* can abut with a front end of the sheet P guided toward the sheet conveying portion 40 as shown in FIG. 8A.

Figure 8B:
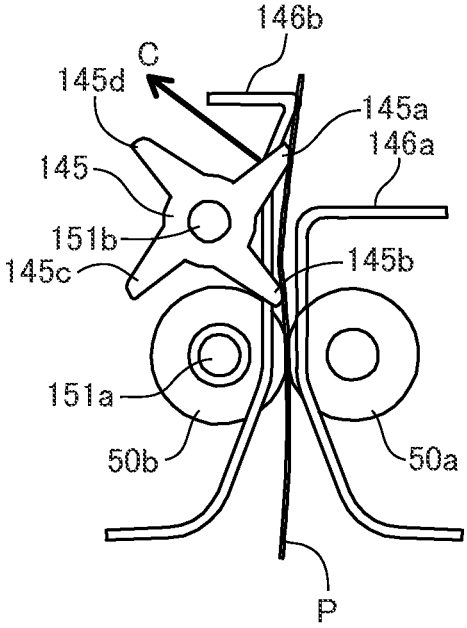
FIG. 8B is a section view showing a state in which the rotary member is positioned at a recede position.

Still further, as shown in FIG. 8B, the protruding portions 145*a* through 145*d* are formed such that the protruding portion 145*a* pushed by the sheet P recedes from the sheet conveying path and the next protruding portion 145*b* is positioned to a recede position where the protruding portion 145*b* stands by being in contact with a surface of the sheet P moving through the sheet conveying path. Although the present embodiment will be explained by exemplifying the rotary member 145 having the four protruding portions 145*a* through 145*d*, the number of the protruding portions is not limited to be four.

The conveying guide 146 includes an upper guide 146*a* disposed on the conveying roller pair 50 side and a lower guide 146*b* disposed on the conveying driven roller 50*b* side. The upper guide 146*a* includes a first upstream guide portion located upstream in the sheet conveying direction of the nip portion 55 of the conveying roller pair 50 and a downstream upper guide portion located downstream in the sheet conveying direction. The lower guide 146*b* includes a second upstream guide portion located upstream in the sheet conveying direction of the nip portion 55 of the conveying roller pair 50 and a downstream lower guide portion (downstream guide) located downstream in the sheet conveying direction of the nip portion 55 of the conveying roller pair 50.

The first upstream guide portion of the upper guide 146*a* and the second upstream guide portion of the lower guide 146*b* guides the sheet P fed by the feed roller 12 to the nip portion 55 of the conveying roller pair 50. The downstream upper guide portion of the upper guide 146*a* and the downstream lower guide portion of the lower guide 146*b* guide the sheet P that has passed through the nip portion 55 of the conveying roller pair 50 to the secondary transfer portion 26. Still further, the downstream lower guide portion of the lower guide 146*b* is arranged such that the protruding portions 145*a* through 145*d* positioned at the recede position by being pushed by the sheet P do not protrude out of the conveying surface connecting the nip portion 55 of the conveying roller pair 50 and the downstream lower guide portion as shown in FIG. 8B. In other words, the downstream lower guide portion is arranged such that at least a part thereof is positioned on a side opposite from the rotational shaft 151*b* of the rotary member 145 from an extension line of a line connecting the protruding portions 145*a* and 145*b*.

Next, a sheet detecting operation performed by the sheet conveying portion 140 constructed as described above will be explained with reference to FIGS. 8A and 8B.

When the sheet P is fed from the feed roller 12, the sheet P comes into contact with the second upstream guide portion of the lower guide 146*b* and is guided toward the nip portion 55 of the conveying roller pair 50 while sliding on the second upstream guide portion. The sheet P guided toward the nip portion 55 of the conveying roller pair 50 abuts against the protruding portion 145*a* positioned at the standby position upstream of the nip portion 55 and pushes the protruding portion 145*a* by resisting against the bias force of the positioning portion 48. After that, the protruding portion 145*a* recedes from the sheet conveying path by being pushed by the sheet P, and the sheet P is nipped and conveyed by the nip portion 55 of the conveying roller pair 50. At this time, while the next protruding portion 145*b* tries to move to the standby position by being biased by the bias force of the positioning portion 48, the protruding portion 145*b* stands by in a state in contact with the surface of the sheet P because the sheet P is in the midst of the move.

Still further, in synchronism with that, the shading flag 47 rotates and shades the light emitting and receiving portions of the photo sensor 53, and the photo sensor 53 transmits a predetermined signal. The passage of the sheet P is then detected by the control portion 80 receiving the signal. That is, the photo sensor 53 is a detecting portion detecting the rotation of the rotary member 145 and thereby, the passage of the sheet is detected.

When the sheet P passes on the protruding portion 145*b*, the next protruding portion 145*b* is moved to the standby position by the positioning portion 48. It is thus possible to shorten a time required until when the next protruding portion 145*b* is positioned to the standby position by rotating the rotary member 145 to position the next protruding portion 145*b* to the standby position with the passage of the sheet P. Accordingly, it is possible to shorten the distance between the sheets being fed.

Here, if the sheet P jams when the protruding portion 145*a* recedes from the sheet conveying path and the next protruding portion 135*b* is positioned at the recede position where the protruding portion 145*b* stands by while being in contact with the surface of the sheet P, the sheet conveying portion 140 stops in this state. If the jammed sheet is pulled in a direction of an arrow C shown in FIG. 8B to remove the jammed sheet from this state, the pulled jammed sheet pushes the protruding portion 145*a* in the direction of the arrow C and the rotary member 145 rotates if there is no downstream lower guide portion. If the rotary member 145 rotates, the protruding portion 145*b* turns toward the sheet conveying path. If the protruding portion 145*b* turns, the jammed sheet positioned at the sheet conveying path is damaged by the protruding portion 145*b* and is also possibly torn. If the jammed sheet is damaged, there is a possibility that it cannot be used even if it can be taken out. Still further, if the jammed sheet is torn within the sheet conveying portion 140, it becomes difficult to unjam the jammed sheet.

Then, in the third embodiment, the downstream lower guide portion is arranged such that the protruding portions 145 through 145*d* positioned at the recede position by being pushed by the sheet P do not protrude out of the conveying surface connecting the nip portion 55 of the conveying roller pair 50 and the downstream lower guide portion. In other words, in the state in FIG. 8B, the downstream lower guide portion is arranged such that at least a part thereof is positioned on the side opposite from the rotational shaft 151 of the rotary member 145 from the extension line of the line connecting the protruding portions 145*a* and 145*b*. Due to that, even if the jammed sheet is pulled in the direction of the arrow C, it is possible to prevent the rotary member 145 from rotating unnecessarily because the jammed sheet slides along the downstream lower guide portion. This arrangement makes it possible to prevent the jammed sheet from being damaged or torn.

The downstream lower guide portion guides the sheet P to the secondary transfer portion 26 during the normal conveying operation, so that it is possible to provide the sheet conveying portion 140 allowing the stable sheet conveyance and the easy unjamming operations. It is noted that the upstream and downstream guides may be integrally formed or may be separately formed unless the restricting portion is provided.

While the embodiments of the present invention have been explained above, the present invention is not limited to the embodiments described above. The advantageous effects described in the embodiments of the invention are merely an enumeration of most suitable effects brought about from the invention and the effects of the present invention are not limited to those described in the embodiment of the invention.

For instance, although the restricting portion has been provided downstream in the sheet conveying direction in the embodiments described above, the present invention is not always limited to that as long as the restricting portion is disposed on the side where a jammed sheet is pulled. That is, in a case where the jammed sheet is pulled from upstream of the nip portion 55, the restricting portion may be provided on the side upstream in the sheet conveying direction of the nip portion 55. Still further, although the above-mentioned embodiments have explained by exemplifying the electrophotographic printer 100, the present invention is not limited to that. For instance, the present invention is applicable to an ink-jet type printer (image forming apparatus) configured to form an image on a sheet P by discharging ink droplets from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-225443, filed on Oct. 30, 2013 which is hereby incorporated by reference herein in its entirety.

What is claimed is:

1. A sheet conveying apparatus comprising:

an apparatus body including a sheet conveying path;

a conveying roller pair including a first roller provided on one side with respect to the sheet conveying path and a second roller provided on another side with respect to the sheet conveying path, the conveying roller pair conveying the sheet along the sheet conveying path by nipping the sheet by a nip portion between the first and second rollers;

a rotary member provided on a second roller side with respect to the sheet conveying path, the rotary member including a first abutment portion and a second abutment portion; and a downstream guide, guiding the sheet conveyed by the nip portion, disposed on a downstream side in the conveying direction and on the second roller side with respect to the sheet conveying path, the downstream guide including:

a restricting portion provided on a point of the downstream guide, the point protruding most to the sheet conveying path, the restricting portion being configured such that the first abutment portion is positioned between a straight line connecting the restricting portion and the nip portion, and the downstream guide in a state in which the second abutment portion is in contact with a surface of the sheet as the rotary member rotates in the predetermined direction by the first abutment portion being pushed by the sheet, wherein the rotary member is provided coaxially with the second roller.

2. The sheet conveying apparatus according to claim 1, wherein the restricting portion includes a guide roller guiding the sheet that has passed through the nip portion along the sheet conveying path.

3. The sheet conveying apparatus according to claim 1, wherein the apparatus body is configured to permit to access to the sheet conveying path from an outside of the apparatus body on the downstream side in the conveying direction of the nip portion.

4. The sheet conveying apparatus according to claim 3, wherein the apparatus body is configured such that an image forming unit having an image forming portion configured to form an image on the sheet conveyed by the conveying roller pair is detachably mounted above, and wherein the downstream guide is opened to permit to connect to a conveying guide on the image forming unit side at an upper surface of the apparatus body.

5. The sheet conveying apparatus according to claim 1, wherein the first abutment portion is a portion against which a front end, with respect to the conveying direction, of a first sheet abuts in a state in which the rotary member is positioned at a first abutment position, the rotary member being rotated in a predetermined direction from the first abutment position by the first abutment portion being pushed by the first sheet, wherein the second abutment portion is a portion against which a front end, with respect to the conveying direction, of a second sheet conveyed following the first sheet abuts in a state in which the rotary member is positioned at a second abutment position rotated in the predetermined direction from the first abutment position, the rotary member being rotated in the predetermined direction from the second abutment position by the second abutment portion being pushed by the second sheet, and wherein the rotary member corrects a skew of a sheet conveyed to the nip portion by causing the first and second abutment portions to abut against the sheet on the side upstream, with respect to the conveying direction, of the nip portion of the conveying roller pair at the first and second abutment positions.

6. The sheet conveying apparatus according to claim 5, further comprising:

a positioning mechanism positioning the rotary member to the first and second abutment positions.

7. The sheet conveying apparatus according to claim 6, wherein the positioning mechanism is configured to position the rotary member at the second abutment position by rotating the rotary member in the predetermined direction after the rotary member starts to be rotated in the predetermined direction by the first abutment portion being pushed by the first sheet.

8. The sheet conveying apparatus according to claim 6, wherein the positioning mechanism includes a cam member, a cam follower contacting with the cam member, and an elastic member biasing the cam follower toward the cam member.

9. The sheet conveying apparatus according to claim 1, further comprising:

a detecting portion configured to detect a rotation of the rotary member.

10. An image forming apparatus comprising:

the sheet conveying apparatus as set forth in claim 1; and an image forming portion configured to form an image on a sheet conveyed by the sheet conveying apparatus.

11. The image forming apparatus according to claim 10 further comprising:

an image forming apparatus body including the image forming portion, wherein the sheet conveying apparatus is detachably mounted with the image forming apparatus body and to permit to access to the sheet conveying path from an outside of the apparatus in a state in which the sheet conveying apparatus is detached from the image forming apparatus body.

12. A sheet conveying apparatus comprising:

an apparatus body;

a conveying roller pair including a first roller provided on one side with respect to a sheet conveying path and a second roller provided on another side with respect to the sheet conveying path, the conveying roller pair conveying the sheet along the sheet conveying path by nipping the sheet by a nip portion between the first and second rollers;

a rotary member provided on a second roller side with respect to the sheet conveying path, the rotary member including:

(a) a first abutment portion against which a front end, with respect to the conveying direction, of a first sheet abuts in a state in which the rotary member is positioned at a first abutment position, the rotary member being rotated in a predetermined direction from the first abutment position by the first abutment portion being pushed by the first sheet; and (b) a second abutment portion against which a front end, with respect to the conveying direction, of a second sheet conveyed following the first sheet abuts in a state in which the rotary member is positioned at a second abutment position rotated in the predetermined direction from the first abutment position, the rotary member being rotated in the predetermined direction from the second abutment position by the second abutment portion being pushed by the second sheet;

an upstream guide configured to guide the sheet from the upstream side in the conveying direction toward the nip portion along the sheet conveying path; and a downstream guide guiding the sheet being nipped and conveyed by the nip portion of the conveying roller pair on the side downstream in the conveying direction of the nip portion, the downstream guide having a restricting portion provided on the second roller side with respect to the sheet conveying path and protruding to the first roller side, and the restricting portion being configured to protrude such that the second abutment portion is positioned on the second roller side rather than a guide surface of the first roller side of the upstream guide in a state in which a front end portion of the first abutment portion is positioned on a straight line connecting a point protruding most to the sheet conveying path of the restricting portion and the nip portion, wherein the restricting portion is composed of a guide roller guiding a sheet that has passed through the nip portion along the sheet conveying path.

13. The sheet conveying apparatus according to claim 12, wherein the apparatus body is configured such that an image forming unit having an image forming portion configured to form an image on the sheet conveyed by the conveying roller pair is detachably mounted above, and wherein the downstream guide is opened to permit to connect to a conveying guide on the image forming unit side at an upper surface of the apparatus body.

14. A sheet conveying apparatus comprising:

an apparatus body including a sheet conveying path;

a conveying roller pair including a first roller provided on one side with respect to the sheet conveying path and a second roller provided on another side with respect to the sheet conveying path, the conveying roller pair conveying the sheet along the sheet conveying path by nipping the sheet by a nip portion between the first and second rollers;

a rotary member provided on a second roller side with respect to the sheet conveying path, the rotary member including a first abutment portion and a second abutment portion; and a downstream guide, guiding the sheet conveyed by the nip portion, disposed on a downstream side in the conveying direction and the second roller side with respect to the sheet conveying path, the downstream guide including a restricting portion provided on a point of the downstream guide, the point protruding most to the sheet conveying path, the restricting portion being configured such that the first abutment portion is positioned between a straight line connecting the restricting portion and the nip portion, and the downstream guide in a state in which the second abutment portion is in contact with a surface of the sheet as the rotary member rotates in the predetermined direction by the first abutment portion being pushed by the sheet, wherein the first abutment portion is a portion against which a front end, with respect to the conveying direction, of a first sheet abuts in a state in which the rotary member is positioned at a first abutment position, the rotary member being rotated in a predetermined direction from the first abutment position by the first abutment portion being pushed by the first sheet, wherein the second abutment portion is a portion against which a front end, with respect to the conveying direction, of a second sheet conveyed following the first sheet abuts in a state in which the rotary member is positioned at a second abutment position rotated in the predetermined direction from the first abutment position, the rotary member being rotated in the predetermined direction from the second abutment position by the second abutment portion being pushed by the second sheet, and wherein the rotary member corrects a skew of a sheet conveyed to the nip portion by causing the first and second abutment portions to abut against the sheet of the side upstream, with respect to the conveying direction, of the nip portion of the conveying roller pair at the first and second abutment positions.

* * * * *